US007253777B2

(12) United States Patent
Blaschke et al.

(10) Patent No.: US 7,253,777 B2
(45) Date of Patent: Aug. 7, 2007

(54) OUTSIDE STRUCTURE CONFORMAL ANTENNA IN A SUPPORTING STRUCTURE OF A VEHICLE

(75) Inventors: Detlev Blaschke, Unterhaching (DE); Clemens Brand, Unterhaching (DE); Kay Dittrich, Hoehenkirchen (DE); Oliver Nagy, Munich (DE); Jan Ritter, Riede (DE); Robert Sekora, Kirchseeon (DE); Herbert Zippold, Bruckmuehl (DE)

(73) Assignee: EADS Deutschland GmbH, Ottobrunn (DE)

( * ) Notice: Subject to any disclaimer, the term of this patent is extended or adjusted under 35 U.S.C. 154(b) by 132 days.

(21) Appl. No.: 11/000,916

(22) Filed: Dec. 2, 2004

(65) Prior Publication Data

US 2005/0156786 A1 Jul. 21, 2005

(30) Foreign Application Priority Data

Dec. 3, 2003 (DE) ..... 103 56 395

(51) Int. Cl.
*H01Q 1/32* (2006.01)

(52) U.S. Cl. ..... 343/713; 343/713; 343/700 MS

(58) Field of Classification Search ..... 343/700 MS, 343/713, 705

See application file for complete search history.

(56) References Cited

U.S. PATENT DOCUMENTS

| | | | | |
|---|---|---|---|---|
| 5,061,938 | A * | 10/1991 | Zahn et al. | 343/700 MS |
| 5,184,141 | A | 2/1993 | Connolly et al. | |
| 5,414,434 | A * | 5/1995 | Conant et al. | 343/700 MS |
| 5,918,183 | A * | 6/1999 | Janky et al. | 455/456.1 |
| 6,684,085 | B1 * | 1/2004 | Haruyama | 343/702 |
| 6,947,008 | B2 * | 9/2005 | Tillery et al. | 343/824 |
| 2003/0063030 | A1 * | 4/2003 | Stoiljkovic et al. | 343/700 MS |
| 2004/0056801 | A1 * | 3/2004 | Apostolos | 343/700 MS |
| 2004/0080459 | A1 * | 4/2004 | Marx | 343/703 |
| 2004/0169608 | A1 * | 9/2004 | Sampo et al. | 343/711 |

FOREIGN PATENT DOCUMENTS

| | | |
|---|---|---|
| EP | 391634 | 10/1990 |
| JP | 58/120302 | 7/1983 |
| WO | 0074171 | 12/2000 |

OTHER PUBLICATIONS

"Westinghouse Developing 'Smart-Skin' Technology", *Aviation Week & Space Technology*, Jun. 12, 1989, p. 284.

Ozdemir, T. et al.; "A Hybridization of Finite-Element and High-Frequency Methods for Pattern Prediction for Antennas on Aircraft Structures", *IEEE Antennas and Propagation Magazine*, vol. 28, Nr. 3, Jun. 1996, p. 28-38.

(Continued)

*Primary Examiner*—Thuy V. Tran
*Assistant Examiner*—Dieu Hien Duong
(74) *Attorney, Agent, or Firm*—Greenblum & Bernstein, P.L.C.

(57) ABSTRACT

An antenna mounted on a supporting system primary structure of a vehicle, in which the supporting system primary structure has an indentation. The antenna includes an EM functional core incorporated into the indentation of the supporting system primary structure, and a cover plate forming one of an upper and outer cover of the EM functional core that is structured and arranged as a conformal outside. Furthermore, boundary areas of the cover plate are connected with the supporting system primary structure. The instant abstract is neither intended to define the invention disclosed in this specification nor intended to limit the scope of the invention in any way.

29 Claims, 3 Drawing Sheets

OTHER PUBLICATIONS

Robert Sekora et al.; Conformal Airborne Array Antenna for Broad Band Data Link Applications in the X-Band (Sep. 19, 2003).
Robert Sekora et al.: Strukturintegrierte Flugzeugantenne fur Breitbandanwendungen im X-Band. (Oct. 2, 2002).
Patent Abstracts of Japan, Bd. 007, Nr. 229 (E203), Oct. 12, 1983. Published on Jul. 18, 1983.

* cited by examiner

OUTSIDE STRUCTURE CONFORMAL ANTENNA IN A SUPPORTING STRUCTURE OF A VEHICLE

CROSS-REFERENCE TO RELATED APPLICATIONS

The present application claims priority under 35 U.S.C. §119 of German Patent Application No. 103 56 395.6, filed on Dec. 3, 2003, the disclosure of which is expressly incorporated by reference herein in its entirety.

BACKGROUND OF THE INVENTION

1. Field of the Invention

The invention relates to an outside structure conformal antenna and in particular, to a flat broadband antenna in a supporting structure of a vehicle and more specifically an aircraft, whereby the supporting structure is in particular a supporting system primary structure.

2. Discussion of Background Information

The term "aircraft" relates to all conceivable devices that can be propelled through the air by any drives, devices such as airplanes, helicopters, airships, drones, rockets, and the like. The example of rockets shows that the invention can also relate to aircraft or missiles that are suitable to fly both in the air and in space.

The increasing number of avionic functions in aircraft, in particular in airplanes, also causes the required number of antennae to rise correspondingly. Today, up to 60-antennae systems and more are no longer a rarity. This problem requires new ways of mounting or housing antennae, e g., in airplanes. A potential solution of this problem is the integration of the antennae into the supporting structures of vehicles and/or aircraft.

For the solution of the stated problem it must also be taken into account that the use of future airborne data transmission systems requires a large high frequency (HF) bandwidth because of immense amounts of data. For this reason, increasingly higher frequencies are used. At present, the market largely offers systems in the X or Ku band.

In addition to the demand for a large bandwidth, naturally a long data transmission range is demanded. This can only be achieved by antennae with a correspondingly big aperture or with arrays that are composed of several individual radiators. Airborne pivoting reflector antennae are now available as commercial products. Their housing, however, is usually a problem. Therefore, consideration has also already been given to using parts of, e.g., the airplane surface as a radiating aperture instead of using a relatively big reflector antenna.

Up to now, e.g., an airplane structure has had the exclusive function of fulfilling load-carrying and aerodynamic tasks. The structural surface correspondingly has had to withstand various mechanical loads.

With the expansion of the function of the structural surface of aircraft to act also as an antenna, additional problems arise in terms of the stability of the structures. For electronic reasons, suitable materials must be used for the antennae; thereby, however, the load-carrying function of the structure must not be affected adversely.

For the aforementioned reasons, the experts are increasingly refraining from building or using antennae that stand out from the structure or the outer shell of vehicles and/or aircraft in the form of rods, spirals, horn parts or other shapes. Thus, flow resistances can be diminished, and the danger of purely mechanical damage to the antennae can at least be reduced somewhat.

The mentioned problem led to the development of outside structure conformal antennae and to their alignment with the predetermined form of structures in vehicles and/or aircraft as far as possible or in an optimal, i.e., identical manner.

For the known prior art in this matter, reference is made to a publication by Dipl.-Ing. Robert Sekora et al. with the title "Conformal Airborne Array Antenna for Broad Band Data Link Applications in the X-Band." This treatise essentially shows the differences between conventional and more up-to-date outside structure conformal antenna systems that are closely aligned with the structure—in this case that of airplanes.

Another pertinent prepublication, also by Dipl.-Ing. Robert Sekora, entitled "Strukturintegrierte Flugzeugantenne für Breitbandanwendungen im X-Band." In this publication, the author explains the structural integrability of an array antenna. Furthermore, the structural setup in terms of its electromagnetic function is confirmed.

SUMMARY OF THE INVENTION

An aspect of the invention is to integrate outside structure conformal antennae into the supporting structures and in particular into supporting system primary structures of vehicles and/or aircraft in such a way that any aerodynamic disadvantages are avoided, and the structural strength in the integration areas is maintained to the greatest possible extent, while simultaneously safeguarding the antenna functionality.

According to the invention, the aspect is attained with the characteristics of an outside structure conformal antenna in a supporting structure of a vehicle and in particular an aircraft. The antenna is incorporated into an indentation of a supporting system primary structure in a positive and/or non-positive manner in the form of a flatly embodied EM functional core in such a way that the upper or outer cover of the EM functional core is realized outside structure conformally by a cover plate. In its boundary areas, is in turn also connected in a positive and/or non-positive manner with the supporting system primary structure. In further embodiments, the cover plate can be made of a dielectric material. The cover plate can be made of one of quartz glass/epoxy, E glass/epoxy, and Q glass/polyester. The EM functional core as well as the cover plate or the front dielectric, respectively, can be connected with the supporting system primary structure by a glue layer. The surfaces to be connected with each other run parallel to each other between the supporting-system primary structure and the cover plate, so that contact surfaces can be formed for the gluing of supporting-system primary structure and cover plate. The indentation of the supporting-system primary structure can be formed by the bending-in of the boundary areas according to the angles.

According to the invention, an outside structure conformal antenna is incorporated into a corresponding indentation in a supporting-system primary structure in a positive and/or non-positive manner in the form of a flatly embodied EM functional core in such a way that the upper or outer cover of the antenna is realized outside structure conformally by a cover plate, which, in its boundary areas, is in turn also connected in a positive and/or non-positive manner with the supporting-system primary structure.

The non-positive connection can be realized in the form of a glue layer. A positive connection can be realized according to the invention by screws or also by rivets.

For antenna-technological reasons, the above-mentioned cover plate is advantageously embodied as a so-called front dielectric.

As compared to conventional antenna constructions, the invention thus offers significant weight and volume savings, which have a particularly advantageous effect in airplanes. Aerodynamic disadvantages are reduced with use of the invention, since the shape of the outer shell of the structures remains completely unchanged. By now, practical examinations have shown that the structural strength is affected by the invention at the most to a negligibly small extent.

Furthermore, structurally integrated antennae according to the invention offer, particularly in aircraft, the opportunity to be arranged in areas that so far have not been justifiable or have even been unsuitable for conventional antennae. Furthermore, the invention renders it possible to incorporate antennae into rudder or flap structures in airplanes or also into fuelled structures if appropriate precautions are taken with regard to the high-frequency lines.

From an electronic perspective, the structural integration of the antenna according to the invention leads to a considerable potential in terms of the reduction of the radar signature as compared to conventional antenna construction methods. Therefore, the antennae according to the invention also lend themselves to use in stealth airplanes (stealth aircraft).

In principle, it can also be stated last but not least that the electronic or electromagnetic properties, respectively, of the antenna construction according to the invention completely satisfy the expectations or demands placed on them.

Further advantageous embodiments of the invention result from the specification.

One aspect of the invention is directed to an antenna mounted on a supporting system primary structure of a vehicle, in which the supporting system primary structure has an indentation. The antenna includes an EM functional core incorporated into the indentation of the supporting system primary structure, and a cover plate forming one of an upper and outer cover of the EM functional core that is structured and arranged as a conformal outside structure. Furthermore, boundary areas of the cover plate are connected with the supporting system primary structure.

In a further aspect of the invention, the antenna can be conformable to an outside structure of the vehicle. Moreover, the EM functional core can be substantially flat. Additionally, the EM functional core incorporation can be one of positive and non-positive. Furthermore, the boundary areas include one of a positive and non-positive connection with the supporting system primary structure. Moreover, the vehicle can be an aircraft. Additionally, the cover plate can be made of a dielectric material. Furthermore, the cover plate can be made of one of quartz glass/epoxy, E glass/epoxy, and Q glass/polyester. Moreover, at least one of the EM functional core, the cover plate, and a front dielectric can be connected with the supporting system primary structure by a glue layer. Additionally, the antenna can include surfaces that connect with each other and that are positioned parallel to each other between the supporting system primary structure and the cover plate such that contact surfaces are formed for gluing the supporting system primary structure and the cover plate. Furthermore, the indentation of the supporting system primary structure can be formed by bending the boundary areas to predetermined angles.

Another aspect of the invention is a method of mounting an antenna to a surface of a vehicle having an indentation. The method includes placing an EM functional core into the indentation of the surface, arranging a cover plate as one of an upper cover and outer cover on the EM functional core, and connecting boundary areas of the cover plate of the EM functional core to the surface.

In a further aspect of the invention, the antenna can be conformable to the surface of the vehicle. Moreover, the EM functional core can be substantially flat. Additionally, the cover plate can be made of a dielectric material. Furthermore, the cover plate can be made of one of quartz glass/epoxy, E glass/epoxy, and Q glass/polyester. Moreover, the method can further include gluing at least one of the EM functional core, the cover plate, and a front dielectric to the surface. Additionally, the method can include bending the boundary areas of the surface to predetermined angles to form the indentation. Moreover, a conformal antenna can be mounted on a surface of a vehicle according to the above-noted method.

Yet another aspect of the invention is an antenna mounted in an indentation of a surface of a vehicle. The antenna includes an EM functional core incorporated into the indentation of the surface and a cover plate structured and arranged as one of an upper and outer cover of the EM functional core. Moreover, the cover plate being structured and arranged to form an aerodynamic surface covering the indentation.

In a further aspect of the invention, the EM functional core can be substantially flat. Moreover, the cover plate can be made of a dielectric material. Furthermore, the cover plate can be made of one of quartz glass/epoxy, E glass/epoxy, and Q glass/polyester. Additionally, at least one of the EM functional core, the cover plate, and a front dielectric can be connected with the surface by a glue layer. Moreover, the antenna can be conformable to the surface of the vehicle.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
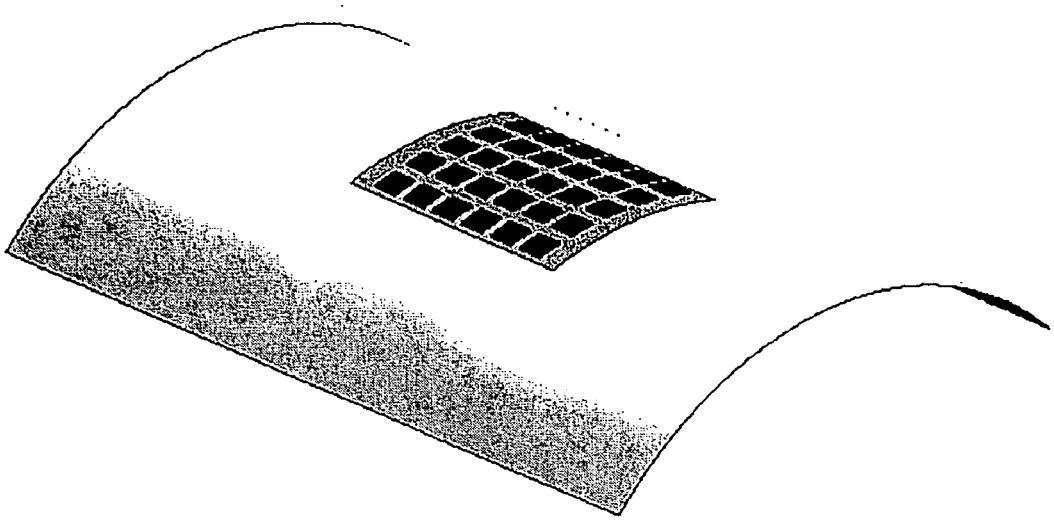
FIG. 1*a* shows a top view of a structurally integrated, outside structure conformal antenna.
Figure 1B:
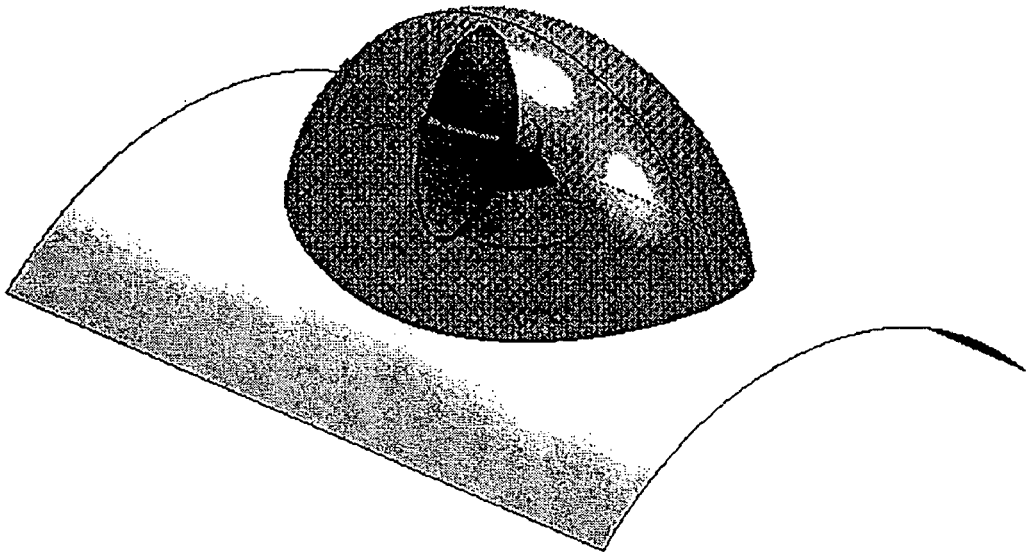
Fig. 1b (Prior Art)
FIG. 1*b* shows an example of a reflector antenna that is exclusively available commercially, bulky, mechanically pivoting and centrally fed.

FIG. 1*a* graphically illustrates the advantages of an antenna according to the invention as compared to a conventional antenna according to FIG. 1*b*. FIG. 1*a* represents a completely outside structure conformal antenna subsystem, e.g., for a broadband data link in the microwave range. The integration of the antenna according to the invention into the airplane structure avoids any aerodynamic disadvantages that could be caused by an antenna, while maintaining the structural strength to the largest extent possible.

From an electronic perspective, the antenna according to the invention features a large relative high-frequency bandwidth in relation to a low reflection factor.

The invention thus offers a real alternative to the conventional antennae, in particular also to the reflector antennae shown in FIG. 1*b*, especially since comparable electronic properties are achieved within the scope of the invention with, at the same time, considerably lower integration volume and lower masses. Furthermore, the invention provides additional arrangement areas for antennae, in particular in airplane structures, which areas are inaccessible to conventional antennae for various reasons.

Figure 2:
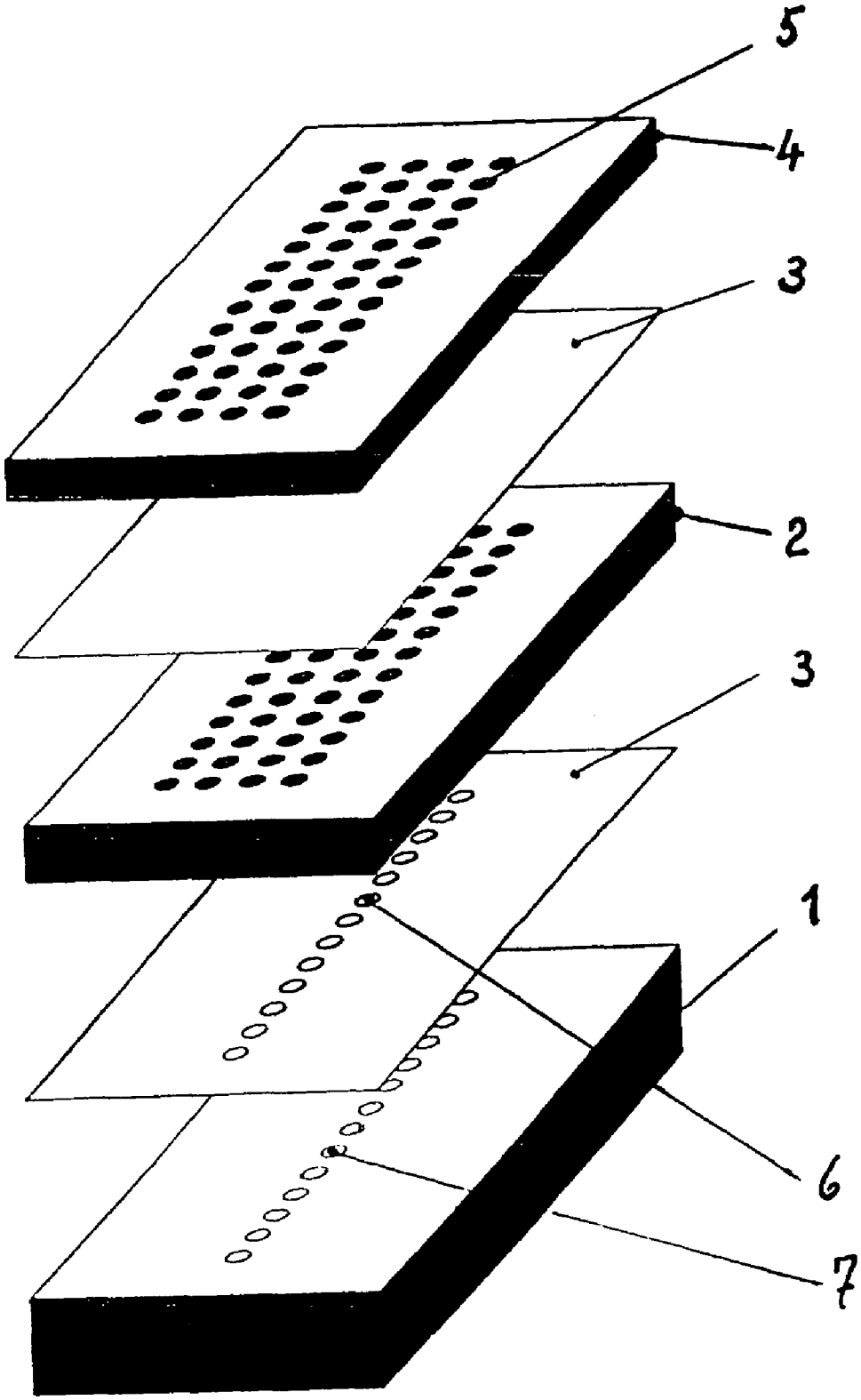
FIG. 2 shows a structural design for an outside structure conformal antenna, as can be used according to the invention.

FIG. 2 shows an example of the setup of an antenna, e.g., in planar structural shape according to the invention in its essential components. A supporting-system primary structure 1 of an aircraft here forms the basis for the mounting of the antenna, which structure is made of carbon fiber reinforced plastic (CFRP) in many application cases. The actual electromagnetic (henceforth abbreviated EM) functional core 2 of the antenna is connected with the supporting-system primary structure 1 by a suitable glue layer 3. The essential upper or outer structurally aligned cover of the antenna is formed by a cover plate in the form of a front dielectric 4, which is connected with the electromagnetic functional core 2 also by a glue layer 3. The upper aperture radiators of the antenna, which are mounted to the front dielectric 4, have the reference number 5.

The cover plate is preferably made of quartz glass/epoxy, E glass/epoxy, or Q glass/polyester.

The congruent borehole series 6 and 7 are gaps for the electric cabling of the outside structure conformal antenna according to the invention.

The total thickness of the antenna according to the invention preferably amounts to several millimeters, so that its integration into an airplane structure has no or at the most only a negligibly small structural impact.

Figure 3:
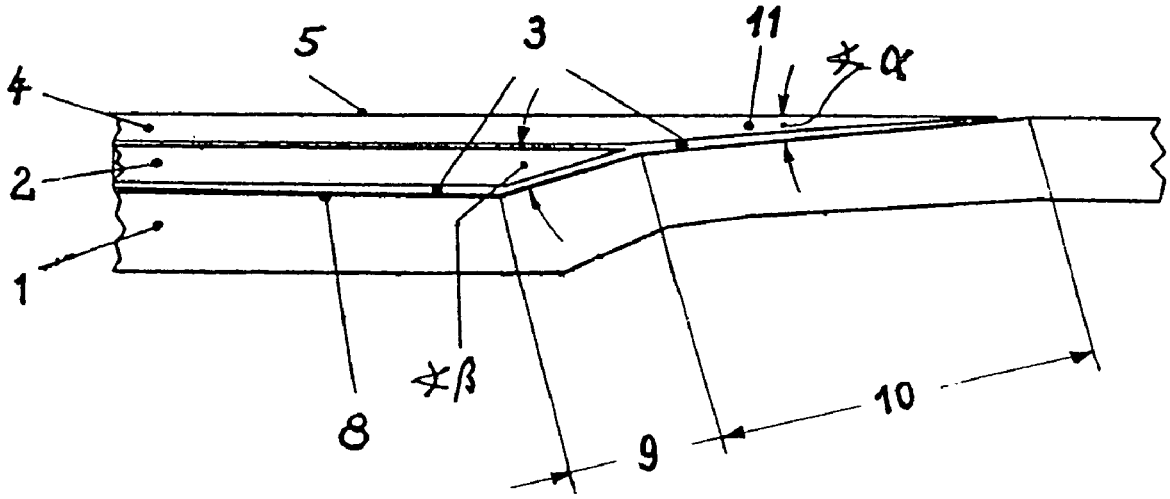
FIG. 3 shows the integration according to the invention of an outside structure conformal antenna according to FIG. 2 into an airplane supporting-system primary structure.

FIG. 3 shows a possibility for the optimum insertion or integration of an antenna into the supporting-system primary structure 1, e.g., in an airplane. To this end, the supporting-system primary structure 1 has an indentation 8 or a sectionwise recess that is brought about by bending-in of the areas 9 and 10 of the supporting-system primary structure 1 at an acute angle. Alternatively to this, transitions can also be realized at an obtuse angle or in stages, if necessary; at an angle $\beta=90°$, the area 9 of the supporting-system primary structure 1 could thus be bent downwards vertically in an extreme case, so that the EM functional core 2 could also be embodied rectangularly in its edge areas.

By contrast, the angle $\alpha$ should remain an acute angle within the scope of the invention, since the size of the glue surface in area 10 of the supporting-system primary structure 1 for the correspondingly tapered part 11 of the front dielectric 4 depends on the dimension of angle $\alpha$; the smaller, i.e., the more acute the angle $\alpha$ is, the bigger becomes the glue surface in area 10 of the supporting-system primary structure 1.

In a radial dimension, the area 9 provides room for the integration of the EM functional core 2, whereas the bending-in of the supporting-system primary structure 1 in area 10 renders possible the load-carrying, outside-contour-maintaining gluing-in of a cover plate in the form of a front dielectric 4.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An antenna mounted on a supporting system primary structure of a vehicle, in which the supporting system primary structure has an indentation, said antenna comprising:

an EM functional core incorporated into the indentation of the supporting system primary structure; and a cover plate forming one of an upper and outer cover of the EM functional core that is structured and arranged to conform to an outside of the supporting system primary structure, wherein boundary areas of the cover plate are connected with the supporting system primary structure, wherein the indentation of the supporting system primary structure is formed by bending boundary areas to predetermined angles, and wherein one of the predetermined angles is an acute angle $\alpha$.

2. The antenna according to claim 1, wherein the antenna is conformable to an outside structure of the vehicle.

3. The antenna according to claim 1, wherein the EM functional core is substantially flat.

4. The antenna according to claim 1, wherein the EM functional core incorporation is one of positive and non-positive.

5. The antenna according to claim 1, wherein the boundary areas comprise one of a positive and non-positive connection with the supporting system primary structure.

6. The antenna according to claim 1, wherein the vehicle is an aircraft.

7. The antenna according to claim 1, wherein the cover plate is made of a dielectric material.

8. The antenna according to claim 7, wherein the cover plate is made of one of quartz glass/epoxy, E glass/epoxy, and Q glass/polyester.

9. The antenna according to claim 1, wherein at least one of the EM functional core, the cover plate, and a front dielectric is connected with the supporting system primary structure by a glue layer.

10. The antenna according to claim 9, further comprising surfaces that connect with each other and that are positioned parallel to each other between the supporting system primary structure and the cover plate such that contact surfaces are formed for gluing the supporting system primary structure and the cover plate.

11. The antenna according to claim 1, wherein the boundary areas of the supporting system primary structure comprise inner bent portions and outer bent portions.

12. The antenna according to claim 11, wherein an angle $\beta$ of the inner bent portions is a different acute angle than the acute angle $\alpha$ of the outer bent portions.

13. The antenna according to claim 11, wherein an angle $\beta$ of the inner bent portions is a larger acute angle than the acute angle $\alpha$ of the outer bent portions.

14. The antenna according to claim 1, wherein the supporting system primary structure is made of carbon fiber reinforced plastic (CFRP).

15. A method of mounting an antenna to a surface of a vehicle having an indentation comprising:

bending boundary areas of the surface to predetermined angles to form the indentation;

placing an EM functional core into the indentation of the surface;

arranging a cover plate as one of an upper cover and outer cover on the EM functional core; and connecting boundary areas of the cover plate of the EM functional core to the surface, wherein one of the predetermined angles is an acute angle $\alpha$.

16. The method according to claim 15, wherein the antenna is conformable to the surface of the vehicle.

17. The method according to claim 15, wherein the EM functional core is substantially flat.

18. The method according to claim 17, wherein the cover plate is made of one of quartz glass/epoxy, E glass/epoxy, and Q glass/polyester.

19. The method according to claim 15, wherein the cover plate is made of a dielectric material.

20. The method according to claim 15, further comprising:

gluing at least one of the EM functional core, the cover plate, and a front dielectric to the surface.

21. A conformal antenna mounted on a surface of a vehicle according to the method of claim 15.

22. The method according to claim 15, wherein the surface is part of a supporting system primary structure made of carbon fiber reinforced plastic (CFRP).

23. An antenna mounted in an indentation of a surface of a vehicle comprising:

an EM functional core incorporated into the indentation of the surface; and a cover plate structured and arranged as one of an upper and outer cover of the EM functional core, the cover plate being structured and arranged to form an aerodynamic surface covering the indentation, wherein the indentation of the surface is formed by bending boundary areas to predetermined angles, and wherein one of the predetermined angles is an acute angle $\alpha$.

24. The antenna according to claim 23, wherein the EM functional core is substantially flat.

25. The antenna according to claim 24, wherein the cover plate is made of one of quartz glass/epoxy, E glass/epoxy, and Q glass/polyester.

26. The antenna according to claim 23, wherein the cover plate is made of a dielectric material.

27. The antenna according to claim 23, wherein at least one of the EM functional core, the cover plate, and a front dielectric are connected with the surface by a glue layer.

28. The antenna according to claim 23, wherein the antenna is conformable to the surface of the vehicle.

29. The antenna according to claim 23, wherein the surface is part of a supporting system primary structure made of carbon fiber reinforced plastic (CFRP).

* * * * *